US011618129B2

(12) United States Patent
Alary et al.

(10) Patent No.: US 11,618,129 B2
(45) Date of Patent: Apr. 4, 2023

(54) SINTERED POLYCRYSTALLINE FLAT-SHAPED GEOMETRICALLY STRUCTURED CERAMIC ABRASIVE ELEMENT, METHOD OF MAKING AND USE THEREOF

(71) Applicant: ImerTech SAS, Paris (FR)

(72) Inventors: Jean-André Alary, L'Isle-sur-la-Sorgue (FR); Florent Polge, Villach (AT); Patrick Ronach, Steuerberg (AT)

(73) Assignee: IMERTECH SAS, Paris (FR)

( * ) Notice: Subject to any disclaimer, the term of this patent is extended or adjusted under 35 U.S.C. 154(b) by 1045 days.

(21) Appl. No.: 15/774,294

(22) PCT Filed: Nov. 3, 2016

(86) PCT No.: PCT/EP2016/076496

§ 371 (c)(1),
(2) Date: May 8, 2018

(87) PCT Pub. No.: WO2017/080897

PCT Pub. Date: May 18, 2017

(65) Prior Publication Data

US 2020/0254587 A1 Aug. 13, 2020

(30) Foreign Application Priority Data

Nov. 9, 2015 (DE) ..... 10 2015 119 213.6
Nov. 2, 2016 (DE) ..... 10 2016 120 863.9

(51) Int. Cl.
*B24D 3/28* (2006.01)
*B24D 5/12* (2006.01)

(52) U.S. Cl.
CPC ..... *B24D 3/28* (2013.01); *B24D 5/12* (2013.01)

(58) Field of Classification Search
CPC ..... B24D 3/28; B24D 5/12; B24D 3/22
(Continued)

(56) References Cited

U.S. PATENT DOCUMENTS 4,314,827 A * 2/1982 Leitheiser ..... C04B 35/10 51/298
5,035,723 A * 7/1991 Kalinowski ..... B24D 3/06 51/309

(Continued)

FOREIGN PATENT DOCUMENTS

EP 0 725 045 A1 8/1996
JP 2002 036121 A 2/2002
WO WO 2017/080897 5/2017

OTHER PUBLICATIONS

International Search Report and Written Opinion dated Mar. 20, 2017, in International Application No. PCT/EP2016/076496 (15 pgs.).

*Primary Examiner* — Joseph J Hail
*Assistant Examiner* — Shantese L McDonald
(74) *Attorney, Agent, or Firm* — Finnegan, Henderson, Farabow, Garrett & Dunner LLP

(57) ABSTRACT

The present invention relates to sintered polycrystalline flat-shaped geometrically structured ceramic abrasive elements designed for the use in resin bonded wheels, particularly in cut-off wheels. The present invention also relates to a method of making such sintered polycrystalline flat-shaped geometrically structured ceramic abrasive elements and the use thereof.

18 Claims, 6 Drawing Sheets

(58) Field of Classification Search
USPC ..... 451/539, 548; 51/298, 309, 293, 307, 51/308
See application file for complete search history.

(56) References Cited

U.S. PATENT DOCUMENTS

| | | | | | |
|---|---|---|---|---|---|
| 5,498,269 | A * | 3/1996 | Larmie | C04B 35/119 | 51/295 |
| 5,654,246 | A * | 8/1997 | Newkirk | C04B 35/652 | 501/80 |
| 5,665,127 | A | 9/1997 | Möltgen et al. | | |
| 5,876,470 | A | 3/1999 | Abrahamson | | |
| 2013/0203328 | A1* | 8/2013 | Givot | B24D 5/04 | 451/548 |
| 2015/0190902 | A1* | 7/2015 | Woo | C09K 3/1436 | 451/527 |

* cited by examiner

SINTERED POLYCRYSTALLINE FLAT-SHAPED GEOMETRICALLY STRUCTURED CERAMIC ABRASIVE ELEMENT, METHOD OF MAKING AND USE THEREOF

CLAIM FOR PRIORITY

This application is a U.S. national phase entry under 35 U.S.C. § 371 from PCT International Application No. PCT/EP2016/076496, filed Nov. 3, 2016, which claims the benefit of priority of DE Application Nos. 10 2015 119 213.6, filed Nov. 9, 2015, and 10 2016 120 863.9, filed Nov. 2, 2016, to all of which this application claims priority and all of which are incorporated herein by reference.

TECHNICAL FIELD

The present invention relates to sintered polycrystalline flat-shaped geometrically structured ceramic abrasive elements designed for the use in resin bonded wheels, particularly in cut-off wheels. The present invention also relates to a method of making such sintered polycrystalline flat-shaped geometrically structured ceramic abrasive elements and the use thereof.

BACKGROUND OF THE INVENTION

Cut-off wheels, which are used as examples for resin bonded wheels in the context of the present invention, are a special type of resin bonded wheels, but their exemplification should not be construed to unduly limit this invention. In fact, the inventors found out within the present works that the abrasive elements primarily designed for cut-off wheels are generally suitable for resin bonded wheels.

Cut-off wheels are flat circular wheels mostly used for cutting off material sections. Different types of cut-off wheels are used for the varying materials to be machined such as metal, stainless steel, natural stone, concrete, and asphalt, whereby the cut-off wheels are classified into two main groups, namely resin bonded cut-off wheels and diamond cutting disks. For making resin bonded cut-off wheels, abrasive grains, for example based on corundum or silicon carbide, are mixed together with fillers, powder resins and liquid resins to a mass which is pressed by means of special machines to cut-off wheels of various diameter and thickness. In this process the grinding material is embedded in a glass fiber cloth, enabling the disk to withstand the enormous centrifugal forces occurring with the use of the cut-off wheels. For making diamond cutting disks which are nearly exclusively used for machining natural stone, concrete and asphalt, diamond segments are put on steel blades by different methods such as sintering, soldering, or laser welding.

Over the past years the abrasive industry has consistently been looking for methods to improve the performance of cut-off wheels, particularly focusing on the use of high quality abrasive grains. European patent No. 1 007 599 B1 describes cut-off wheels including a mixture of different sol-gel abrasive grains. European patent No. 0 620 082 B1 describes cut-off wheels including microcrystalline filamentary aluminum oxide particles beside highly abrasive components such as cubic boron nitride or diamond, whereby the abrasive materials are present in the form of segments on a steel blade.

According to US patent application No. 2013/0040537 A1, sol gel derived abrasive grains in the shape of tetrahedrons and pyramids are used in a mixture together with other high quality abrasive grains for resin bonded cut-off wheels. Similar resin bonded cut-off wheels are described in US patent application No. 2013/0203328 A1, wherein sol gel derived ceramic abrasive grains in the shape of triangular platelets, prisms, or truncated regular triangular pyramids are used again beside other high quality abrasive grains in a mixture with phenolic resins, grinding aids, fillers, and other additives.

In comparison to high quality abrasive grains with undefined cutting edges, surprisingly, highly improved performances were reached by means of such abrasive grain mixtures, whereby abrasive grains with definite shapes were used, not only for resin bonded cut-off wheels but generally for resin bonded wheels.

DESCRIPTION OF THE INVENTION

Encouraged by those results, the abrasive industry is still looking for further improvements in performance of resin bonded grinding wheels, particularly cut-off wheels.

Thus, it is one objective of the present invention to provide abrasive materials for use in resin bonded wheels, particularly cut-off wheels, which materials have advantages over the prior art.

The problem is solved by sintered polycrystalline flat-shaped geometrically structured ceramic abrasive elements designed to replace abrasive grains in resin bonded grinding wheels, particularly in resin bonded cut-off wheels.

It is another objective of the present invention to provide a method of making sintered polycrystalline flat-shaped geometrically structured ceramic abrasive elements for use in resin bonded grinding wheels.

This problem is solved by the formation of a ductile ceramic precursor material from which flat-shaped geometrically structured precursors of sintered polycrystalline flat-shaped geometrically structured ceramic abrasive elements are formed, which are sintered to polycrystalline flat-shaped geometrically structured ceramic abrasive elements.

It is another objective of the present invention to provide improved resin bonded grinding wheels, particularly cut-off wheels.

This problem is solved by applying sintered polycrystalline flat-shaped geometrically structured ceramic abrasive elements to replace abrasive grains in resin bonded grinding wheels, particularly cut-off wheels.

Said sintered flat-shaped geometrically structured abrasive elements are sintered shaped bodies having a homogeneous microstructure, a consistent chemical composition across the whole sintered body, and a uniformly structured geometry. The sintered bodies have a first surface and a second surface opposite the first surface and parallel to it. Both surfaces are separated by a sidewall having a thickness (t) between 50 and 2000 μm. The diameter-to-thickness ratio of the sintered shaped bodies is greater than 30, preferably greater than 50. The average diameter of the crystals which form the microstructure of the sintered shaped bodies is less than 10 μm, preferably less than 5 μm.

Preferably, the chemical composition of the sintered polycrystalline flat-shaped geometrically structured ceramic abrasive elements is based on aluminum oxide and/or other chemical compounds selected from the group consisting of carbides, oxides, nitrides, oxy-carbides, oxy-nitrides and carbo-nitrides of at least one of the elements selected from the group consisting of Al, B, Si, Ti and Zr.

The Vickers hardness Hv of the sintered polycrystalline flat-shaped geometrically structured abrasive elements is preferably at least 15 GPa, more preferably at least 18 GPa.

In a preferred embodiment, the density of the sintered polycrystalline flat-shaped geometrically structured abrasive elements is greater than 95% of the theoretical density, more preferred greater than 97.5% of the theoretical density.

Preferably, the abrasive elements are round disks or segments of a circle, each adapted with regard to their diameter and thickness to the grinding wheels to be formed therefrom.

In a preferred embodiment, the abrasive elements are designed as perforated ceramic bodies comprising recesses. Preferably, the perforations or recesses of the ceramic bodies form a homogeneous geometrical structure comprising geometrically shaped openings or recesses. The volume ratio between the openings and the massive parts of the abrasive elements is preferably constant over the whole usable diameter of the disk, whereby the usable diameter is to be understood as the area of the abrasive element, which is used during machining with the abrasive element.

In another preferred embodiment, the sintered polycrystalline flat-shaped geometrically structured ceramic abrasive elements are porous ceramic bodies, which either per se have sufficient porosity to give the grinding wheels the required porosity, or which are additionally perforated or comprise recesses, whereby in this case the perforation or recesses are less developed. Porous ceramic bodies within the meaning of the present invention are those ceramic bodies which are fully interspersed with more or less small pores, whereas the above mentioned perforations and recesses have a large volume and are preferably geometrically structured.

In a preferred embodiment, the chemical composition of the abrasive elements is based on aluminum oxide, whereby the chemical composition comprises at least 50 wt.-% aluminum oxide and optionally one or more oxides selected from the group consisting of $SiO_2$, MgO, $TiO_2$, $Cr_2O_3$, $MnO_2$, $Co_2O_3$, $Fe_2O_3$, NiO, $Cu_2O$, ZnO, $ZrO_2$ and rare earth oxides. However, also other chemical compositions based on oxides, carbides, nitrides, oxy-carbides, oxy-nitrides, and carbo-nitrides of the elements selected from the group consisting of Al, B, Si, Ti, and Zr are suitable materials for manufacturing ceramic abrasive elements according to the present invention.

The production of the ceramic abrasive elements may be carried out in different ways, whereby in all cases, firstly, a ductile ceramic mass is produced, wherefrom the flat-shaped geometrically structured precursors of the ceramic abrasive elements are formed, which are sintered to polycrystalline flat-shaped geometrically structured ceramic abrasive elements.

For example, the ceramic mass or the ceramic precursor material may be obtained by wet ball milling of α-alumina raw material in the presence of dispersants, and subsequent addition of an organic binder and, optionally, a plasticizer and/or antifoaming agent. The dispersion is mixed for several hours as far as a stable colloidal dispersion is formed, which dispersion is processed by tape casting to a film having a thickness up to 3 mm. The tape cast film is dried and precursors of flat-shaped geometrically structured abrasive elements are cut out which are subsequently calcined and sintered.

Aside from the above mentioned process, every method is suitable whereby moldable ceramic masses are obtained wherefrom appropriate abrasive elements may be formed and sintered.

For example, sol-gel processes are also well suited for producing ductile ceramic masses, whereby sol-gel compositions comprising a liquid phase having a ceramic precursor dissolved or dispersed therein can be converted into a ceramic material such as, for example, α-alumina, silica, titania, zirconia or mixtures thereof. Sols suitable for making alumina based ceramics are commercially available boehmite sols having the trademarks "Dispal", "Disperal", "Pural", or "Catapal".

The sol-gel compositions may additionally comprise modifying additives or precursors of modifying additives. The modifying additives can function to enhance the desired properties of the sintered flat-shaped geometrically structured ceramic abrasive elements. Typical modifying additives or precursors of modifying additives are oxides, carbides, nitrides, oxy-carbides, oxy-nitrides, carbo-nitrides or water soluble salts of magnesium, zinc, iron, silicon, cobalt, nickel, zirconium, hafnium, chromium, rare earth, or mixtures thereof.

Additionally or alternatively, the sol-gel compositions may contain a nucleating agent to enhance the transformation of hydrated or calcined aluminum oxide to α-aluminum oxide and to inhibit crystal growth. Nucleating agents suitable for this purpose include fine particles of α-alumina, α-ferric oxide or its precursors, titanium oxide and titanates, chromium oxide or any other material that will nucleate the transformation to α-alumina.

It is a special advantage of a sol-gel process that in this way abrasive elements having a particular fine crystalline structure, a high hardness, and an excellent toughness can be obtained. Also on the sol-gel route, films are formed which are subsequently dried. Precursors of the flat-shaped geometrically structured abrasive elements are cut out and subsequently sintered. Alternatively, the sol-gel derived gels may be directly appropriately formed and sintered.

Further suitable methods of making flat-shaped geometrically structured abrasive elements are injection molding, pressing, extrusion, roll forming and rapid prototyping or additive manufacturing such as, for example, 3D-printing, stereo-lithography, and laminated object manufacturing.

SHORT DESCRIPTION OF THE FIGURES

The present invention is additionally described by means of figures. Thereby,

Figure 10A:
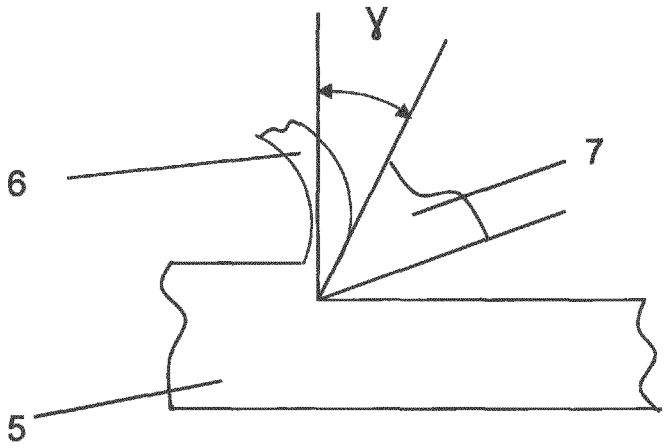
Figure 10B:
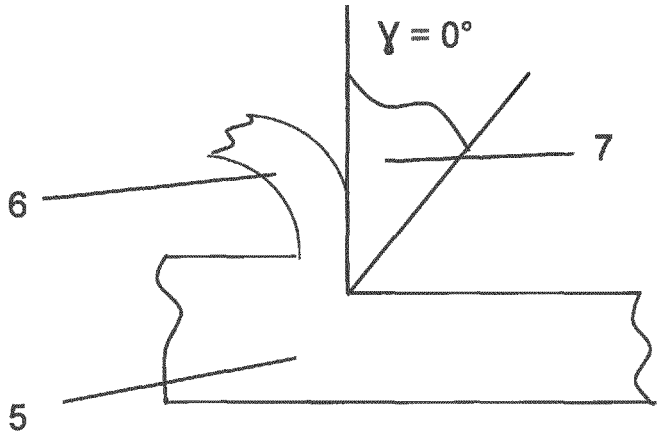
Figure 10C:
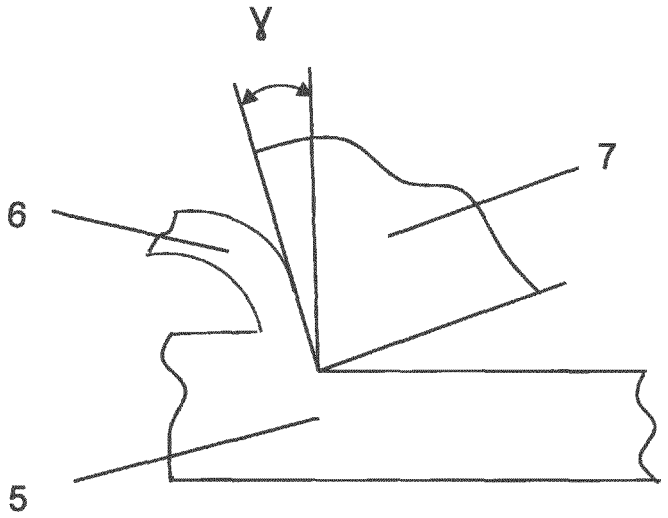

FIGS. 10*a*-10*c* schematically show different rake angles.

The selection of the geometric structures described in the figures above should not be construed to unduly limit this invention. Beside the above illustrated structures, numerous other structures are possible and suitable to solve the problem according to this invention.

DESCRIPTION OF PREFERRED EMBODIMENTS

Figure 1:
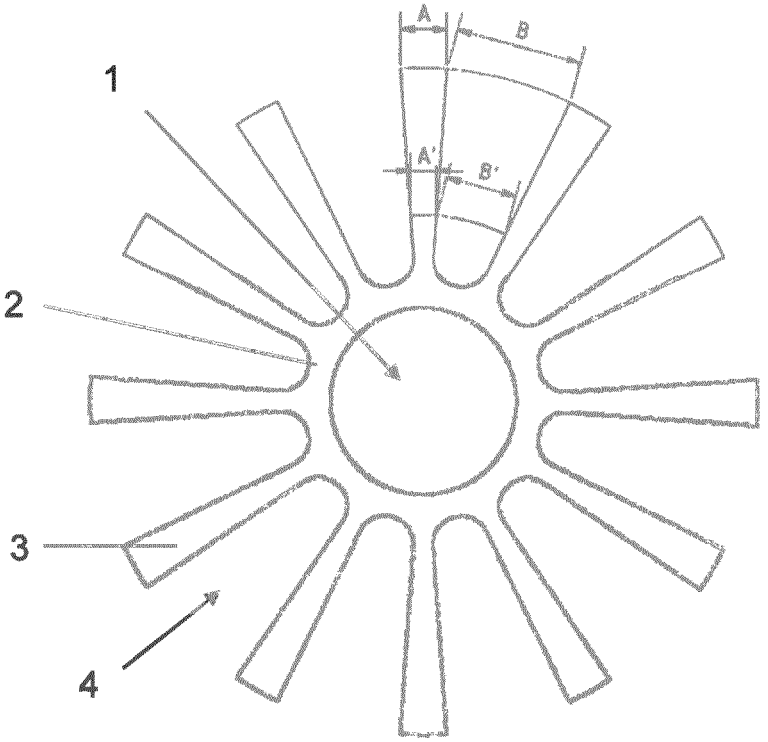
FIGS. 1 to 8 show two dimensional plan views of different geometrically structured ceramic abrasive elements.

FIG. 1 shows a plan view of a radially shaped round ceramic abrasive element. In the middle of the element one can see a center hole 1 corresponding to the hub of the grinding wheel for which the element is designed. The body 2 of the abrasive element is star-shaped whereby the ends of the beams 3 perpendicularly stand to the center hole 1 while forming a circle whereof the diameter corresponds to the diameter of the wheel for which the abrasive element is designed. Between the beams 3 one can see the openings 4 which are suitable to provide the required porosity for the grinding wheel. The dimensions of the openings 4 are such that the volume ratio of the openings 4 to the massive parts of the grinding wheel is constant during machining over the whole diameter of the usable wheel. Thus, it is guaranteed that the porosity of the grinding wheel and with it the abrasion conditions are constant during radial wear of the whole grinding process. This ratio is illustrated in FIG. 1 by the ratio of the distances A B and A'/B', relating to the circumferences U and U", respectively, at a defined wheel diameter.

Figure 2:
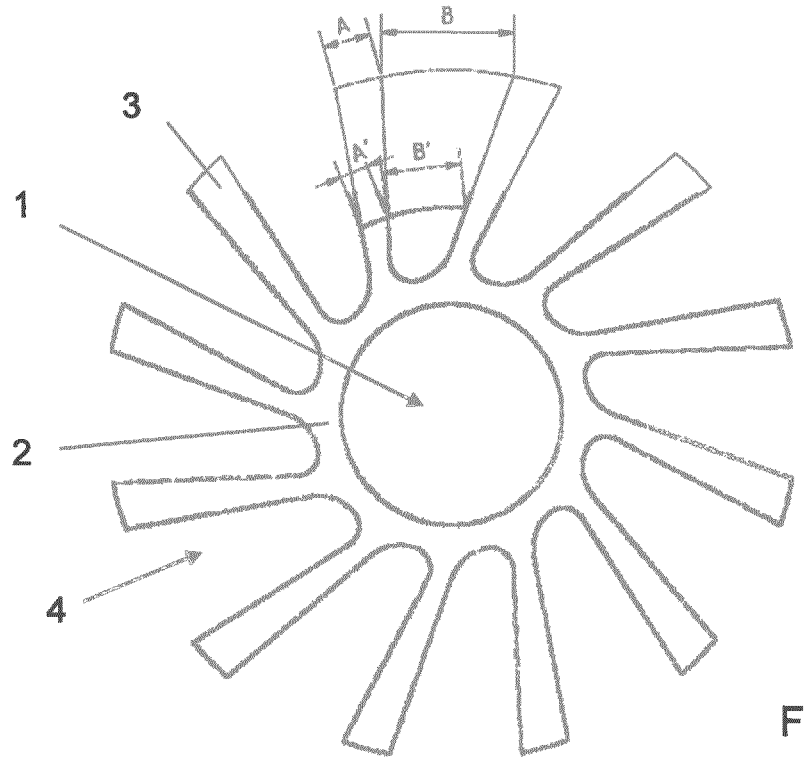
Figure 3:
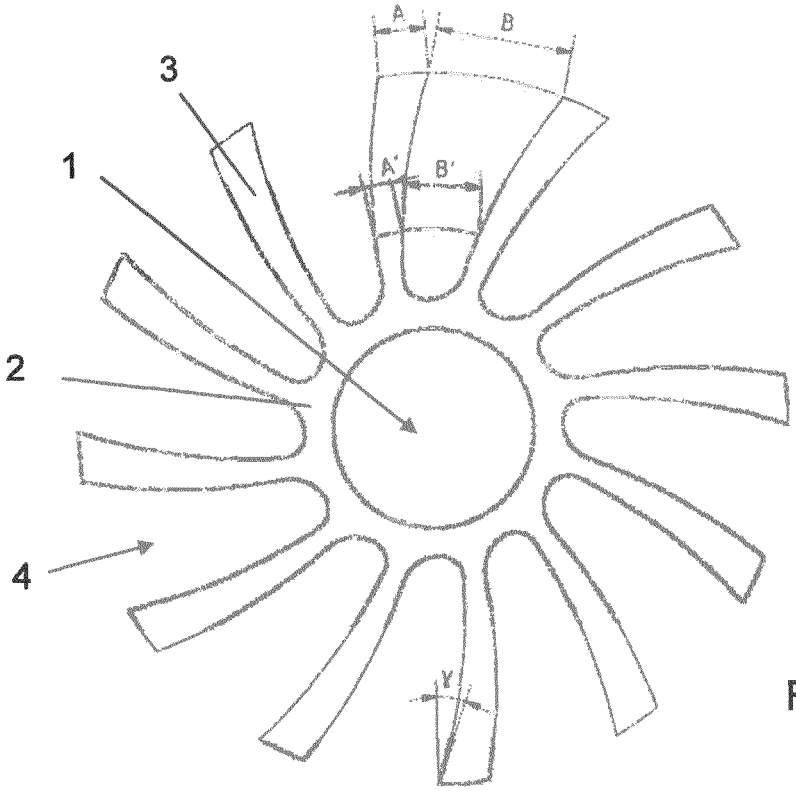

The FIGS. 2 and 3 also show plan views of radially shaped abrasive elements, whereby the beams 3 in FIG. 2 are angled with regard to the center hole 1. In FIG. 3, the beams 3 are additionally curved. Also in these cases, the openings 4 are designed in a manner that the volume ratio of the openings to the massive parts of the abrasive element is constant over the whole abraded diameter of the wheel, which is illustrated by the ratio of the distances A/B and A'/B', respectively, relating to the circumference.

Another feature for characterizing the flat-shaped geometrically structured ceramic abrasive elements is the rake angle γ which corresponds to the angle of inclination of the rake surface (surface of attack) from the reference plane which is orthogonal to the tangent of the disk. Three different types of rake angles are possible: positive, negative or even zero. A positive rake angle γ helps to reduce the cutting force and thus cutting power requirement, whereas a negative rake angle γ increases the edge-strength and the life of the abrasive element or the grinding wheel. The rake angle γ is additionally explained by means of FIGS. 3, 4, 8, 10*a*, 10*b*, and 10*c*.

The abrasive element according to FIG. 3 has a positive rake angle γ of 18°. During the grinding process the rake angle γ falls off to zero with increasing wear (decreasing radius) of the grinding wheel.

Figure 4:
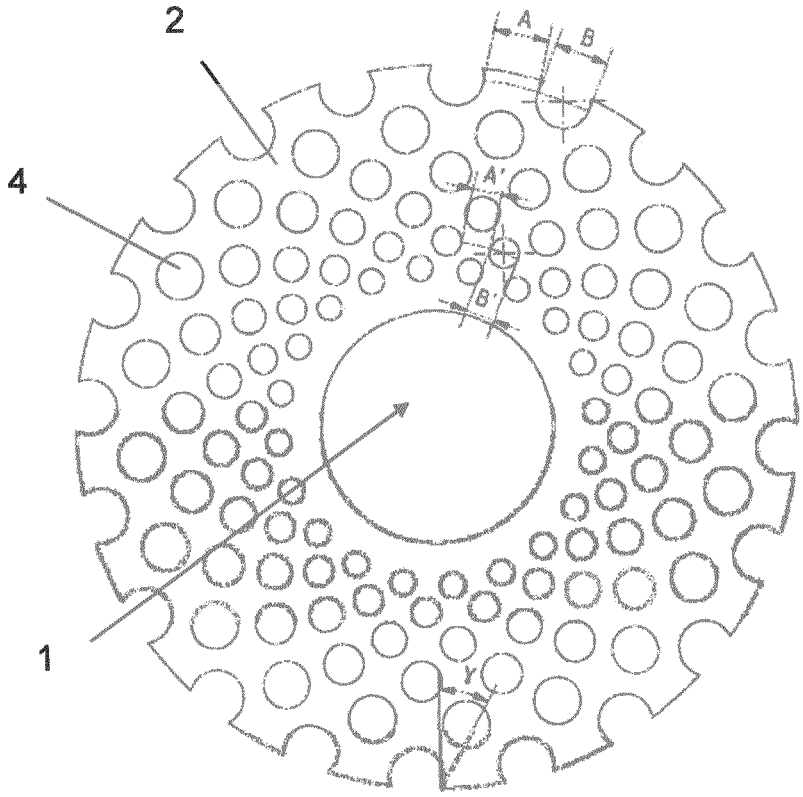

FIG. 4 shows a circular disk-shaped abrasive element. The body 2 of the abrasive element has a center hole 1 corresponding to the hub of the grinding wheel. In this case, the porosity of the grinding wheel is guaranteed by round holes 4 becoming greater with increasing radius of the wheel so that the volume ratio of openings 4 to the massive parts of the abrasive element here also is constant over the diameter used during the grinding process, which is once more illustrated by the ratio of the distances A/B and A'/B' in relation to the circumference. The rake angle γ of the abrasive element starts with +29° and with reduced abrasive wheel radius switches by passing zero into the negative range down to −90°. With the next line of round holes 4 the rake angle γ starts with +90', falls off to zero and switches subsequently into negative range down to −90°. This run is repeated with every new row of holes.

Figure 5:
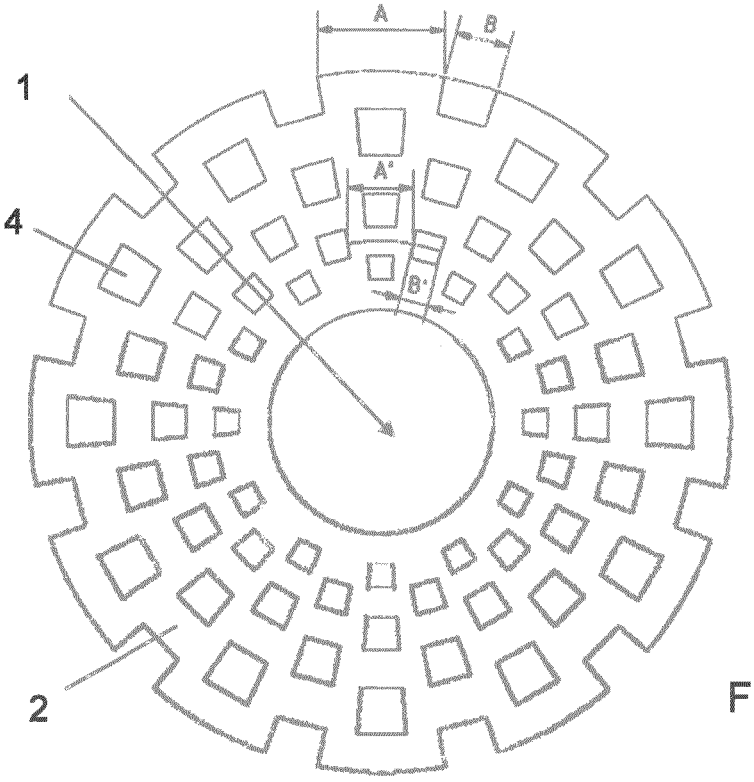
Figure 6:
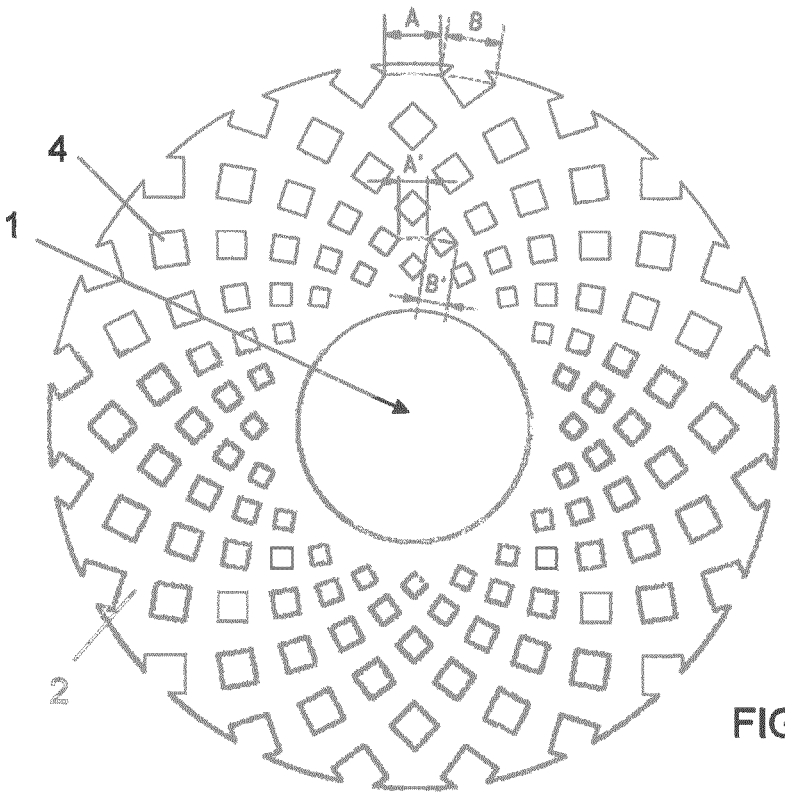
Figure 7:
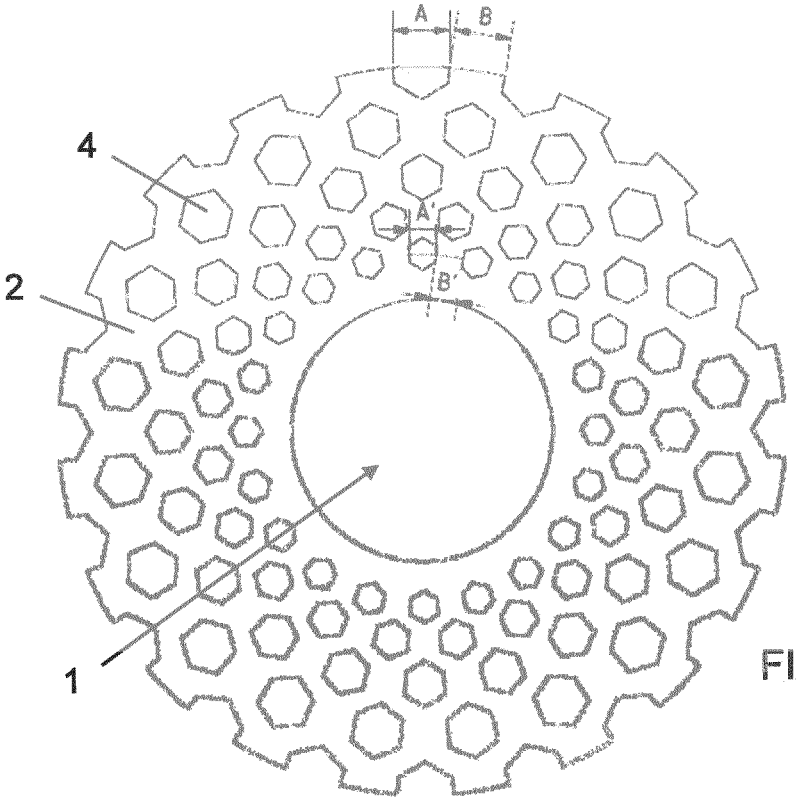
Figure 8:
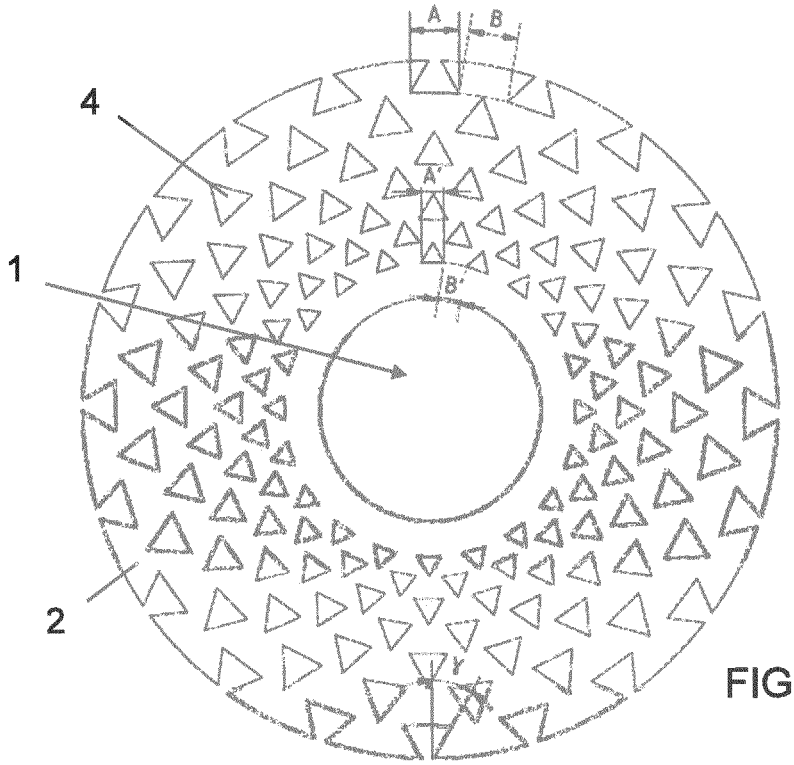

The FIGS. 5 to 8 also show circular disk-shaped abrasive elements having openings 4 with other geometrical structures, Trapezoidal openings 4 are shown in FIG. 5, rhombic openings 4 in FIG. 6, hexagonal honeycomb-shaped openings 4 in FIG. 7, and triangular openings 4 in FIG. 8. In all cases, the volume ratio of the openings 4 to the massive parts of the abrasive elements is constant over the whole diameter of the wheel used during the grinding process, which is illustrated once more by the ratio of the distances A/B and A'/B' in relation to the circumference. The rake angle γ of the abrasive element according to FIG. 8 is 32° and stays constant over the whole grinding process.

The rake angle γ is generally illustrated by means of FIGS. 10*a* to 10*c*, whereby FIG. 10*a* shows a positive rake angle γ, the rake angle γ according to FIG. 10*b* is zero, and FIG. 10*c* shows a negative rake angle γ. During cutting, the abrasive element 7 generates a chip 6 from the workpiece 5, whereby a positive rake angle γ helps to reduce the cutting force and thus cutting power requirement, whereas a negative rake angle γ increases the edge-strength and the life of the abrasive element 7.

Figure 9:
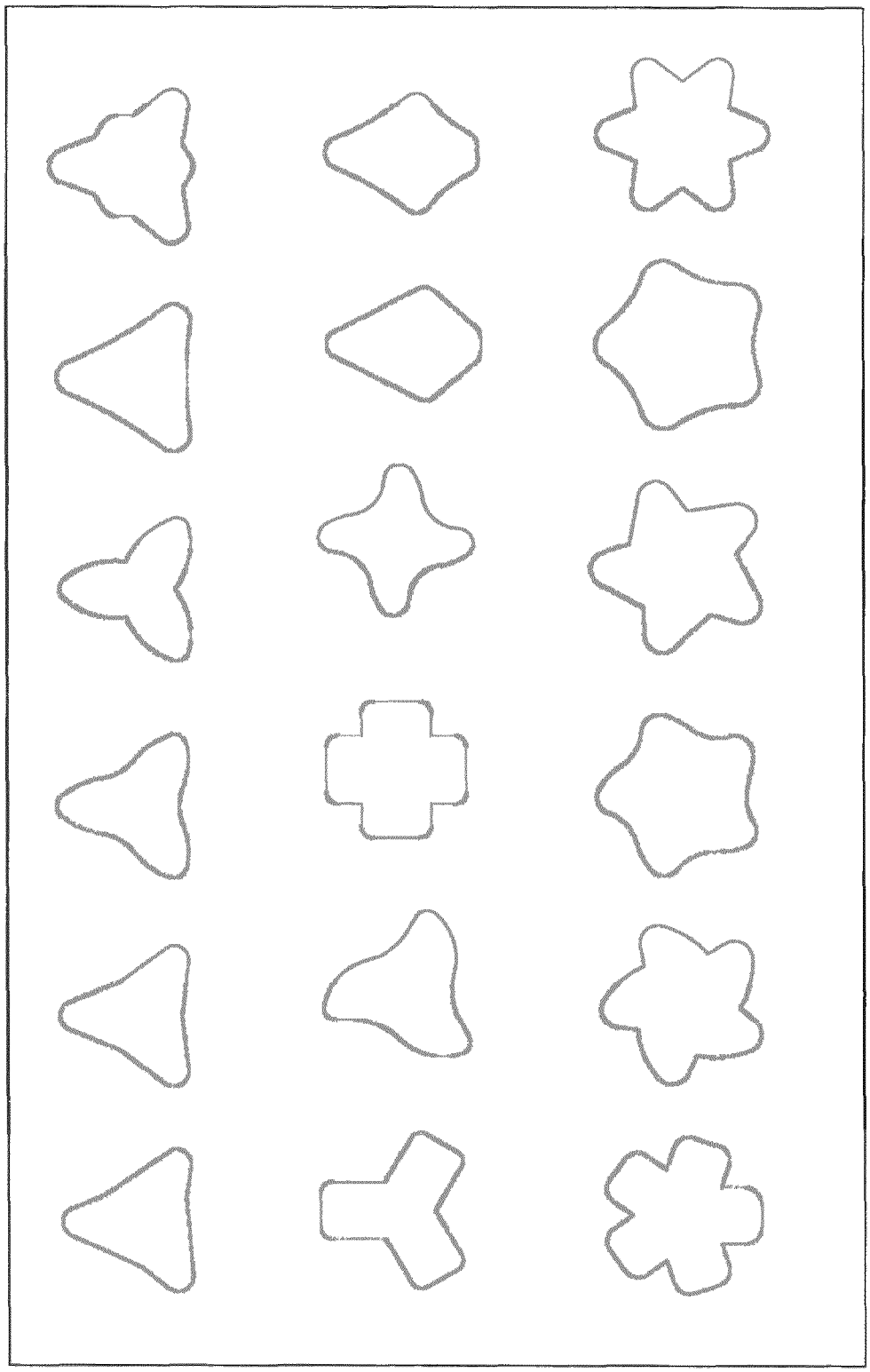
FIG. 9 shows a summary of different geometrical recesses.

As mentioned above, the embodiments of the abrasive elements shown in FIGS. 1 to 8 are an arbitrary selection which should not be construed to unduly limit the scope of the invention. Examples of further geometrical surfaces being suitable shapes of openings or holes are shown in FIG. 9. Also this summary should not be construed to unduly limit the invention.

Beside the full circular abrasive elements shown in FIGS. 1 to 8, it is also possible to accordingly make and use segments of a circle having analogous structures. It is an advantage of the segments that their making and handling is easier with a minor risk of breakage during processing. Appropriate segments of a circle are fractions having the half, one third, a quarter, or one eighth of a full circular abrasive element.

Finally, the geometric configuration of the abrasive elements primarily depends on the field of application of the grinding wheel. A person skilled in the art will choose a simply producible geometric shape wherewith the grinding conditions are most suitably adjustable.

EXAMPLES

An 80% α-aluminum oxide suspension having a mean particle size $d_{50}$ of 0.144 μm was obtained by wet milling α-aluminum oxide starting powder having a mean particle size $d_{50}$ of less than 1 μm, whereby the suspension was stabilized by addition of 0.75 wt.-% polymethacrylate (KV5182, Zschimmer & Schwarz). Then, a latex binder (B-100, Dow Chemicals) was added to the stabilized suspension.

Subsequently, 5 wt.-% of 1.25% aqueous cellulose solution (Methocel K15M) was added to the liquid suspension to increase its viscosity. In this stage, films with differing thicknesses between 200 μm and 500 μm were cast using the above ceramic precursor having an aluminum oxide content of 72.6% by weight and a viscosity of about 1,300 mPa*s, wherefrom precursors of the flat-shaped geometrically structured ceramic abrasive elements were stamped according to the structures of FIGS. 1 to 8.

The precursors were dried whereby, due to the high aluminum oxide content, only small shrinkage and no crack formation was observed. The dried precursors were heated to 600° C. using a heating rate of 1° C./min to remove the binder, and subsequently sintered up to a maximum temperature of 1600° C. using a heating rate of 5° C./min. The holding time at 1600° C. was 30 minutes. The flat-shaped geometrically structured ceramic abrasive elements such obtained have a density of 3.94 g/cm$^3$ (98.3% of the theoretical density), a Vickers hardness Hv of 18.4 GPa, and a crystallite size of less than 2 μm.

Cutoff Test

For making a resin bonded cut-off wheel with a diameter of 125 mm, a flat-shaped geometrically structured ceramic abrasive element according to FIG. 1 having a thickness of 300 μm was used. The resin was additionally mixed with a corundum filler to ensure the stability of the wheel. For comparison, a wheel comprising monocrystalline corundum (TSCTSK, Imerys Fused Minerals) grit size F46/F60 was used as standard.

Round CrNi stainless-steel bars having a diameter of 20 mm were used as workpieces for cut-off tests and the cutting operation was carried out using a wheel speed of 8,800 revolutions per minute and a cutting rate of 6,000 μm/s. For each test, 3 pre-cuts and 12 cuts were performed. Then, the wheel wear was determined based on the reduction of the wheel diameter. The G-ratio was calculated from the ratio of material removal and wheel wear.

The results are summarized in table 1 as follows:

TABLE 1

| Example | G-ratio $cm^2/cm^2$ | performance (%) |
|---|---|---|
| According to FIG. 1 300 μm | 3.41 | 112 |
| Standard TSCTSK 46/60 | 3.04 | 100 |

The above example illustrates the potential of the abrasive elements according to the present invention. By varying the geometric structure, the thickness and their own porosity, customized abrasive elements may be provided for any number of applications. Porous alumina based oxide ceramics are suitable abrasive elements with high proper porosity. The porosity of such ceramics can be adjusted to a pore volume between 10% and 90% by means of well-known ceramic technologies.

Another optimization potential results from applying several abrasive elements incorporated in parallel to each other in one grinding wheel, whereby the hole patterns of the abrasive elements are advantageously staggered with respect to each other, such that the grinding wheel possesses a homogeneous porosity distribution over the whole width of the wheel. An example for such a wheel is a double layered staggered cut-off wheel comprising two flat-shaped geometrically structured ceramic abrasive elements each having a thickness of 150 μm.

Additionally, the physical properties of the abrasive elements may be varied by introducing dopants. For example, the toughness and breaking strength of the abrasive elements can be improved by introducing zirconia. The variations of the raw materials and the production methods are further possibilities for varying and optimizing the abrasive elements according to the present invention. Particular fine crystalline abrasive elements having a crystal size in the range of 100 nm may be obtained by means of well-known technologies via the sol-gel route. Such ceramic abrasive elements have a high toughness and hardness and are particular suitable for machining high-alloy steels.

Additional applications of particular interest are thin resin bonded wheels having a thickness between 100 μM and 200 μm and a minor diameter between 1 cm and 4 cm which are used for dental technologies.

The invention claimed is:

1. An abrasive element comprising a sintered shaped ceramic body having;

a homogeneous microstructure, a consistent chemical composition across the whole sintered body, and a uniformly structured geometry, and a center, wherein the sintered ceramic body has a first surface and a second surface opposite the first surface and parallel to it, the first and second surfaces are separated by a sidewall having a thickness (t) between 50 and 2000 μm, and the diameter-to thickness ratio of the abrasive element is greater than 30, an average diameter of the crystals which form the microstructure of the sintered body is less than 10 μm, and the ceramic body includes a plurality of recesses or perforations, wherein a first distance measured across a first one of the plurality of recesses or perforations is greater than a second distance measured across a second one of the recesses or perforations, the first distance is measured further from the center of the sintered ceramic body than the second distance, and a volume ratio of the plurality of the recesses or perforations to the massive parts of the ceramic body is constant over the whole usable diameter of the abrasive element.

2. The abrasive element according to claim 1, wherein the chemical composition of the abrasive element is based on aluminum oxide and/or other chemical compounds selected from the group consisting of carbides, oxides, nitrides, oxy-carbides, oxy-nitrides and carbo-nitrides of at least one of the elements selected from the group consisting of Al, B, Si, Zr and Ti.

3. The abrasive element according to claim 1, wherein the abrasive element is a circular disk or a segment of a circle.

4. The abrasive element according to claim 1, wherein the perforation of the ceramic body features a homogeneous geometrical structure of geometric shaped openings.

5. The abrasive element according to claim 1, wherein the abrasive element is a porous ceramic body.

6. The abrasive element according to claim 1, wherein the chemical composition of the abrasive element comprises at least 50 wt.-% alumina and one or more oxides selected from the group consisting of $SiO_2$, MgO, $TiO_2$, $Cr_2O_3$, $MnO_2$, $Co_2O_3$, $Fe_2O_3$, NiO, $Cu_2O$, ZnO, $ZrO_2$, and rare earth oxides.

7. A method of manufacturing a ceramic abrasive elements according to claim 1, comprising the steps of:

preparing a ductile ceramic precursor mass;

forming precursors of flat-shaped geometrically structured ceramic abrasive elements from said ductile ceramic precursor mass; and calcining and sintering said precursors of flat-shaped geometrically structured ceramic abrasive elements to obtain sintered flat-shaped geometrically structured ceramic abrasive elements.

8. A method according of manufacturing a ceramic abrasive elements comprising preparing a ductile ceramic precursor mass;

forming precursors of flat-shaped geometrically structured ceramic abrasive elements from said ductile ceramic precursor mass; and calcining and sintering said precursors of flat-shaped geometrically structured ceramic abrasive elements to obtain sintered flat-shaped geometrically structured ceramic abrasive elements;

preparing a dispersion of α-alumina in water by ball-milling α-alumina having an average particle size of less than 1 μm in presence of a dispersant;

adding an organic binder and optionally a plasticizer and/or an antifoaming agent to the dispersion;

mixing the dispersion for several hours to obtain a stable colloidal dispersion;

tape casting the stable colloidal dispersion to a film having a thickness up to 3 mm;

drying the tape cast film;

cutting-out precursors of flat-shaped geometrically structured ceramic abrasive elements; and calcining and sintering the precursors of the ceramic abrasive elements;

wherein each of the ceramic abrasive elements includes a sintered shaped ceramic body having a homogeneous microstructure, a consistent chemical composition across the whole sintered body, and a uniformly structured geometry, wherein the sintered ceramic body has a first surface and a second surface opposite the first surface and parallel to it, the first and second surfaces are separated by a sidewall having a thickness (t) between 50 and 2000 μm, and the diameter-to thickness ratio of the abrasive element is greater than 30, an average diameter of the crystals which form the microstructure of the sintered body is less than 10 μm.

9. A method comprising the use of a ceramic abrasive element according to claim 1 for making resin-bonded grinding wheels.

10. A cut-off wheel comprising a ceramic abrasive element according to claim 1.

11. The abrasive element according to claim 1, wherein the ceramic body comprises perforations.

12. The abrasive element according to claim 1, wherein the first one of the plurality of recesses or perforations is located further from the center of the sintered ceramic body than the second one of the plurality of recesses or perforations.

13. The abrasive element according to claim 1, wherein the plurality of recesses or perforations are round openings.

14. The abrasive element according to claim 1, wherein the plurality of recesses or perforations are trapezoidal openings.

15. The abrasive element according to claim 1, wherein the plurality of recesses or perforations are rhombic openings.

16. The abrasive element according to claim 1, wherein the plurality of recesses or perforations are hexagonal honeycomb-shaped openings.

17. The abrasive element according to claim 1, wherein the plurality of recesses or perforations are triangular openings.

18. The abrasive element according to claim 1, wherein the first and second ones of the plurality of recesses or perforations are openings that extend radially outward from the center of the sintered ceramic body.

* * * * *